United States Patent [19]

Kerwin et al.

[11] 4,029,033

[45] June 14, 1977

[54] CONVENIENCE OPENING OF CONTAINERS FOR LIQUID PRODUCTS

[75] Inventors: Joseph E. Kerwin, Western Springs; Paul M. Erlandson, Palos Park, both of Ill.

[73] Assignee: The Continental Group, Inc., New York, N.Y.

[22] Filed: Oct. 14, 1975

[21] Appl. No.: 622,302

Related U.S. Application Data

[62] Division of Ser. No. 507,036, Sept. 18, 1974.

[52] U.S. Cl. ..... 113/121 C; 222/485; 222/541; 222/563; 220/359; 156/69; 29/458

[51] Int. Cl.[2] ..... B67B 7/00

[58] Field of Search ..... 222/544, 485, 563, 546, 222/541; 220/359, 307; 113/121 C; 29/458; 156/69

[56] References Cited

UNITED STATES PATENTS

| | | | |
|---|---|---|---|
| 3,281,024 | 10/1966 | Henchert et al. | 222/563 X |
| 3,666,138 | 5/1972 | Morris, Jr. et al. | 222/485 |
| 3,804,287 | 4/1974 | Balocca et al. | 220/307 |
| 3,883,034 | 5/1975 | Rausing | 220/359 |
| 3,927,793 | 12/1975 | Langen | 220/359 |

*Primary Examiner*—Allen N. Knowles

*Attorney, Agent, or Firm*—John J. Kowalik; Joseph E. Kerwin; William A. Dittmann

[57] ABSTRACT

An easy opening closure for pressurized fluids and a method of making the same. The container has an end panel with multiple small openings and a tape strip of plastic or plastic coated metal foil is secured to the panel by a heat activated adhesive in a way by which the plastic is extruded into the openings to form hollow bosses each defined by a peripheral annulus or torus formed into the respective opening and at least partially bonded to an uncoated raw edge of the opening, the boss having a disk-like center portion and the surrounding annulus providing a thick cross-section resisting doming of the areas of the tape covering the openings and inhibiting the development of incipient cracks and their propogation resulting in premature peeling of the cohesive bond. The areas of adherence of the adhesive to the external side of the panel are selectively controlled to obtain a desired, preferably uniform, peel resistance to the tape so that upon the tape being pulled by the user to separate it from the container during opening, the user will continue to pull to fully open the pour opening and vent. The invention also provides a permanent securement of the tail end of the strip to the end panel to prevent removal of the strip.

8 Claims, 12 Drawing Figures

CONVENIENCE OPENING OF CONTAINERS FOR LIQUID PRODUCTS

This is a division of Ser. No. 507,036, filed 9/18/74.

DISCUSSION OF THE PRIOR ART

Containers of the general type under consideration are known. U.S. Pat. No. 3,292,828 illustrates a container can end with a plurality of openings which are sealed by a metal foil or plastic tape.

Heretofore it has not been possible to apply tape seals externally (without internal support) to highly pressurized containers. Tape seals have been used to cover pouring apertures in vacuumized products, such as the so-called "hot fill" items, where a resultant vacuum pulls the metalized tape against the end of the container. The same technique could not be applied to pressurized containers because the shear forces produced by the internal pressure would cause progressive peeling or shearing of the adhesive bond. In U. S. Pat. No. 3,292,828 both internal and external seals are required.

Another U. S. Pat. No. 2,870,935 is of interest in that it shows a large opening and suggests spraying the underside of the lid and the cover with adhesive to effectuate a satisfactory seal.

U. S. Pat. No. 3,338,462 illustrates the formation of a plastic plug with an outturned flange beneath the end panel. This construction would undoubtedly require excessive pull to remove if applied to small holes and is complicated to form, not to mention the possibility of pieces breaking off which would be objectionable.

In general, the closures of the instant type have not met with success in the pressurized beverage field because of the excessive requirements to perfect the seal.

SUMMARY OF THE INVENTION

This invention is directed to a novel arrangement for securing a strip of plastic or combination plastic coated metal foil (steel or aluminum) or a foil of steel or aluminum to a can end by an adhesive applied to the underside of the strip, the adhesive being forced into sealing engagement with the can end panel about a plurality of openings therein, the strip including a plastic layer which is extruded from the exterior toward the interior of the panel through the openings and the extrudate being set and formed under heat and pressure into hollow bosses having portions confined by the edges of the openings and including a peripheral rigidifying torus or bead.

A general object of the invention is to provide a pour opening in a can end panel in the form of a plurality of small openings as contrasted to one large opening, of a size and shape to permit sealing of a pressurized container by novel means only externally applied preferably in the form of a metalized tape and an adhesive.

A further object is to incorporate in the combination of a tape covering small openings in the can end, a peelable adhesive bonding or sealing means which provides for high bursting strength and relatively low peeling or shearing forces, and bonding the same by heat sealing, ultrasonic welding, high energy rate impact sealing or the like, the tap also being secured at one end to the can end by a non-peelable adhesive.

Another object is to form a tape which not only seals well to the container but which may be readily pulled away from the pour opening to permit drinking directly from the container.

These and other objects and advantages inherent in and encompassed by the invention wherein.

DESCRIPTION OF THE INVENTION

Figure 1:
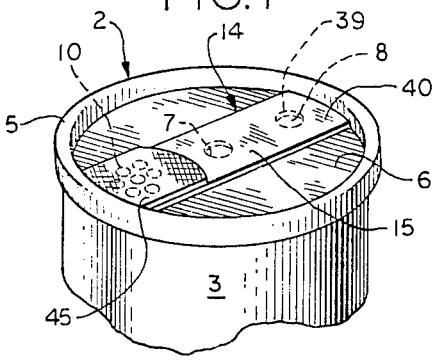
FIG. 1 is a fragmentary perspective view of a container with the novel closure in sealed position.
Figure 2:
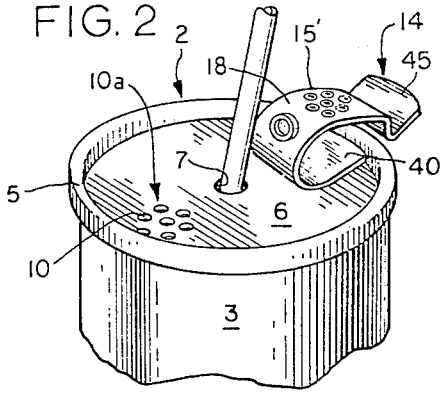
FIG. 2 is a perspective view of a container showing the closure in open position.

Referring to the drawings, there is shown, a can 2 having a body 3 with double seam attachment 5 to an end panel 6.

In the embodiment shown, the panel 6, which is aluminum, is provided with a central straw-admitting vent opening 7, an anchor opening 8, which may be eliminated, and a plurality of small pour openings 10, located adjacent to the peripheral edge 11 of the can. These openings can be of various shapes having at least one rather short lateral dimension, but preferably are circular.

The openings 10, which may be arranged in any preferred pattern, are shown arranged in a circular array about one center opening 10 defining the center of the area and collectively form a pour aperture **10*a*.Each opening 10 has a raw edge 12 which, if the panel is steel, must be coated to prevent corrosion or contamination of flavor to the product in the container it being understood that the openings 10** are punched after the end panel is coated, if steel, by a suitable enamel as stated in the hereinafter disclosed U.S. patents.

A bendable or flexible, gas and liquid impervious, elongated strip or pull tab generally designated 14 of plastic or of thin aluminum or steel foil 15, which is coated with a plastic layer or film 15' of polypropylene resin, serves as a closure tab covering all of the openings. The tape 15 may be an oriented rubber-modified acrylonitrile polymer resin such as Barex or Cycopak material either metalized or not.

Figure 6:
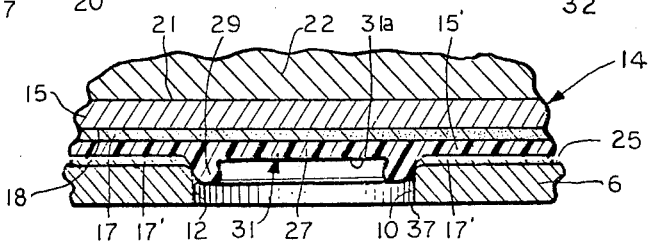
FIG. 6 is an enlarged fragmentary view of a portion of FIG. 5.

The polypropylene layer 15' as shown in the drawings (FIGS. 6 and 7) is adhered to the underside surface 18 of the foil 15 by a bond promoting agent 17. A bond promoting agent which has been found to provide superior results is a carboxylated polypropylene resin as more fully described in U. S. Pat. No. 3,616,047.

Figure 7:
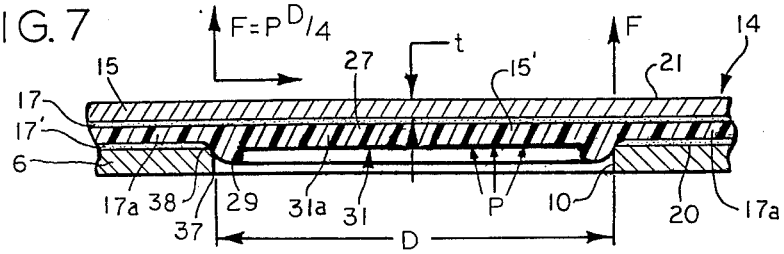
FIG. 7 is an enlarged section taken substantially on line 5—5.
Figure 8:
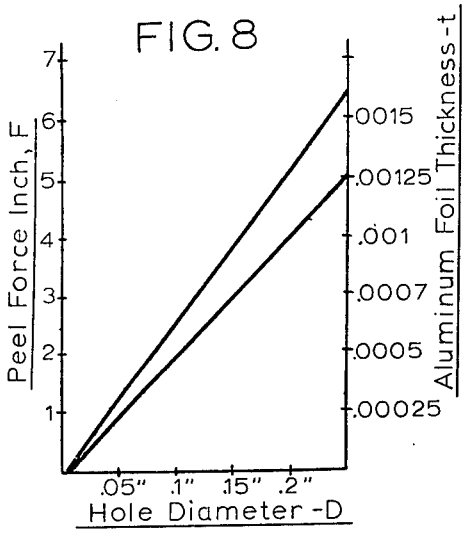
FIG. 8 is a graph of parameters for the tab and hole.

As shown in FIGS. 7 and 8 the strip 14 is applied to the exterior surface of the end panel with the polypropylene layer opposing the panel surface 20. To promote the bonding of the polypropylene layer 15' of the strip 14 to the end panel, an adhesive material 17' is applied, as by spot coating, to the end panel in the areas surrounding the openings. The adhesive 17' is preferably of a low peel strength type that is, the adhesive provides a high strength bond between the polypropylene layer and the end panel, but when removal of the strip is attempted, the strip is readily peelable or clearly separable from the end panel. A peelable adhesive material which has been found to be especially suitable for this application is a carboxylated polypropylene resin which has been treated with a different thermoplastic polymer such as ethylene/vinyl acetate, polymethylmethacrylate or polystyrene as is more fully disclosed in U. S. Pat. No. 3,671,356.

Upon or prior to application of the strip 14 to the peelable adhesive coated panel, the strip 14 is heated. Pressure is applied against its top side 21 preferably by a heated pressure plate or iron 22 which forces the tab or strip against the top side 20 of the end panel. A heated anvil (not shown) may be located beneath the panel, if desired. The pressure against the tape is of such magnitude that the heat-softened polypropylene layer 15' of the strip 14 is squeezed out from between the foil surface and top surface 20 about the openings and extrudes into the openings. The layer 15' about the openings is thinned out as at 17*a* thus materially improving the adhesive quality of the bond and beneficially improving the cohesive bond.

Bosses 31 and 32 having thick disk-like sections 27, 28 of the film material 15' are produced centered respectively in the openings 10 and 7. The disk-sections 27, 28 are respectively edged by a torus or annulus 29, 30 of thick cross-section. The torus extends from the corner edges 38 of the openings beneath the lower faces 31*a* of the disk center portions of the bosses to an area spaced above the lower corner edges 37 of the openings. This type of boss structure not only resists doming, but also inhibits development of cracks about the openings resulting from excessive doming caused by the pressure exerted thereagainst by the pressurized liquid in the container. Such doming, unless restrained, propagates incipient cracks and eventually causes failure of the bond. In actual constructions, the bosses or plugs can be seen and additionally can be felt by running a finger nail against the bottom side of the tape after opening. The structure of the bosses provide structural strength in the critical areas and independent tests have substantiated that the instant constructions have been eminently successful. The closures are required to withstand 100 p.s.i. The instant constructions with the torus shaped bosses have withstood pressures greatly in excess of these requirements, that is up to 270 – 290 p.s.i. using treated carboxylated polypropylene resins as described in the aforesaid U. S. Pat. No. 3,671,356 as the adhesive bonding agents in the pour opening areas. The treated carboxylated polypropylene resin is applied over an enamel coating 25, which may be formed of a thermosetting resin such as epoxy, urea/formaldehyde epoxy/phenolic resin applied to the raw metal surface of the end panel.

By extruding the bosses as described, they are hollow and are stress resistant. Minimal amounts of materials are used. Any partial bonds between the edges of the openings and the extrudate afford a plus factor, although principal reliance is placed upon the bond between the top of the panel and the tape.

Of major concerns are the adhesive peel strength and foil thickness as a function of hole diameter. Assuming each hole to be circular, although they could be slots, arcuate or straight, each hole may be treated separately as long as the effect of one hole does not reach the adjacent hole.

In FIG. 7 a single hole is analyzed and requirements established. In the following analysis: P = internal pressure and D = diameter of each hole, we have the peel force F, per linear inch, as $$F = \frac{PD}{4} \tag{1}$$

The contribution of the inplane component K to the peel force will be negligible, especially for the range of the hole sizes which are to be used. FIG. 8 shows the curve of F vs. D for p = 100psi.

If 6063 aluminum foil is used, the shear strength is 10,000 psi. With a factor of safety of 2 (short time), the required foil thickness $t$ is determined:

$$t = \frac{pD}{20{,}000} \tag{2}$$

This is also shown in the graph illustrated in FIG. 8.

The distance between holes should be such that the peel stress around one hold does not reach the next hole. This condition is achieved if the distance 1, between holes is greater than ($\pi$/n,)

$$\text{or} \quad 1 > \frac{\pi}{n} \tag{3}$$

$$\text{where} \quad n = \left(\frac{3E_1}{Et^3h_o}\right)^{1/4}$$

$E_1$ = modulus of the adhesive
E = modulus of the foil,
$t$ = foil thickness,
and
$h_o$ = adhesive thickness.

For an example, assume the total pouring area = 0.75 in.$^2$, with 30 holes and the adhesive peel strength of 10 No./in.

$$D = \sqrt{\frac{4A}{n\pi}} = \sqrt{\frac{4(0.75)}{30\pi}} = 0.178''$$

Figure 3:
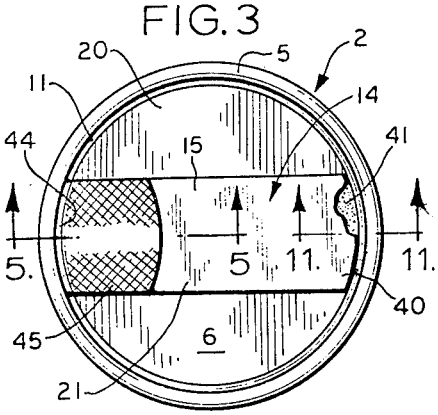
FIG. 3 is a top plan view of the structure shown in FIG. 1.

F = 4.4 lbs./in.
$t$ = 0.00089 inch (foil thickness) ≈ 0.001 inch.
Assume
$E_1$ = 300,000 psi
E = $10^7$ psi
$t$ = 0.001 inch
$h_o$ = 0.001 inch
So
$n$ = 547
And
1 = 0.006 inch = distance between holes The tape should preferably be secured at its anchor end 40 to the end panel by an adhesive 41 (FIG. 3) such as a carboxylated polypropylene resin, an epoxy resin, ethylene-acrylic acid copolymer resin, or a phenol formaldehyde resin which may be applied in the areas of the opening 8. The adhesive 41 may be extruded through the opening 8 and thus form a plug or boss 42 with a torus 43 and a thick center disk 43*a* which additionally mechanically strengthens the area to prevent separation within the defined parameters.

Figure 10:
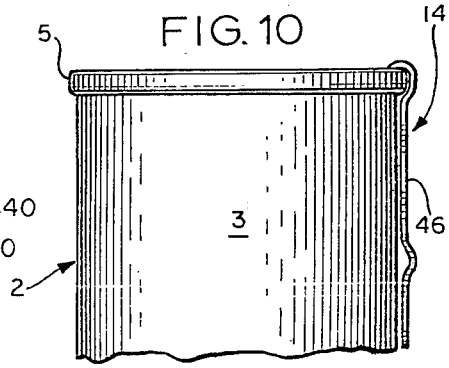
FIG. 10 is a side view of the container showing the tape draped against the side of the container.

The tape may be of greater length than the diameter of the end panel and may be folded at 44 in the groove against the chuck wall and have a free grasping end 45 laid over the adhered portion of the tape. The tape is preferably of a foil like material or metalized plastic that provides sufficient body and shape retention so that it can be bent and reshaped when peeled to be draped down the side of the container opposite the pour openings and closely accommodate itself to the container side wall as at 46 at shown in FIG. 10.

Figure 4:
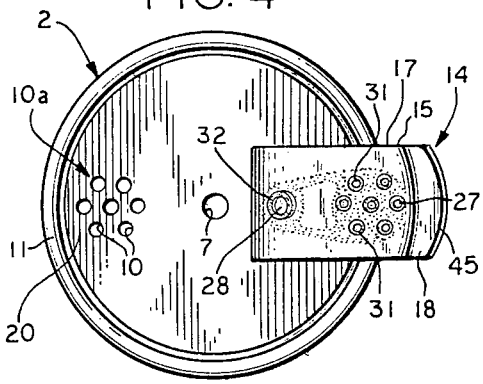
FIG. 4 is a top plan view of the structure shown in FIG. 2.
Figure 5:
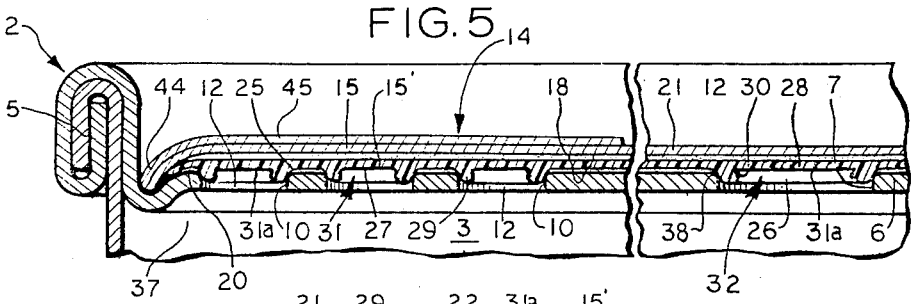
FIG. 5 is an enlarged cross-sectional view taken substantially on line 5—5 of FIG. 3.
Figure 9:
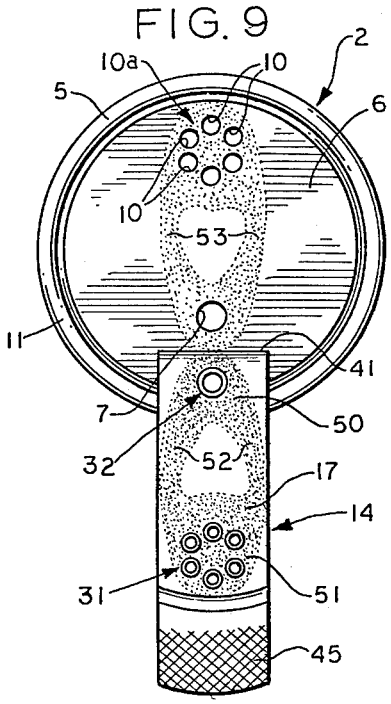
FIG. 9 is a top view of the opened container.
Figure 11:
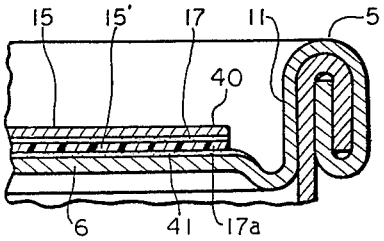
FIG. 11 is an enlarged radial cross-sectional view of a plug section of the container end and tape.
Figure 12:
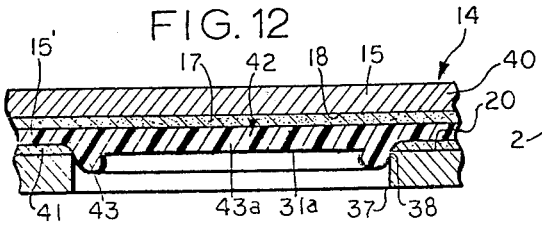
FIG. 12 is also an enlarged radial cross-sectional view of the container and tape.

As best seen in FIGS. 4 and 9, the primary peelable attachment areas of the adhesive are located at 50 and 51, about the openings 7 and 10, respectively, and in laterally spaced strips 52, 52 along the lateral margins of the strip in the region between the areas 50, 51 and also at 53, 53 on the can top. This is accomplished by hollowing out the pressing iron 22 or roller. The function of this spot adhesion is to minimize the adhesion in non-critical areas so as to facilitate lifting of the tab to open position.

To open the can, the tape is grasped by the waffle patterned end 45 and peeled off openings 10 and 7 pulling out the hollow plugs or bosses from these openings. Since the tab is held at its anchor or tail end 40 it may be easily folded over the diametrically opposite side of the can so as not to interfere with drinking directly from the can.

Having described a preferred embodiment of the invention other forms will now become readily apparent to those skilled in the art and as set forth in the appended claims.

What is claimed is:

1. A method of attaching a tape over plural closely spaced small openings in a metal container wall comprising:

the steps of applying an enamel to the wall, then punching said openings in said wall to thereby expose uncoated metal edges forming the margins of said openings, then applying a film of adhesive to the wall in areas about respective openings, then applying a tape at least a portion of which is thermoplastic material to the wall, then pressing the tape with the thermoplastic material covering the openings and applying sufficient pressure to extrude the thermoplastic material as bosses into respective openings each having a relatively thick disk-shaped center section and torus-shaped marginal portion pressed within the edges of respective openings to form relatively thick pressure-resistant islands within the openings.

2. A method of making an easy opening means for a container comprising the steps of providing wall means for said container, providing an opening means in the wall means, providing closure means having at least a film of thermoplastic material in covering relation to said opening means, adhesively bonding with a peelable adhesive said material of said closure means to a portion of the exterior of the wall means about said opening means to effect leak-proof openable closure and concurrently adhesively bonding another portion of said closure means to another portion of the exterior of the wall means with a non-peelable adhesive to non-removably secure the closure means at said other portion of said wall means, and the steps of providing a heat activatable adhesive for bonding in the area of the opening means, and heating said closure means to activate said heat activatable adhesive means and and to soften said film, pressing the closure means against the wall means to extrude a quantity of the film from between the closure and wall means through the opening means to cause a quantity of the film to form peel-resisting means within the opening means for rigidifying the proximate region of said closure means.

3. A method of making an easy opening means for a container comprising the steps of providing wall means for said container, providing an opening means in the wall means, providing closure means having at least a film of thermoplastic material in covering relation to said opening means, adhesively bonding with a peelable adhesive said material of said closure means to a portion of the exterior of the wall means about said opening means to effect leak-proof openable closure and concurrently adhesively bonding another portion of said closure means to another portion of the exterior of the wall means with a non-peelable adhesive to non-removably secure the closure means at said other portion to said wall means; and including the steps of forming said opening means to provide edge means, and applying a predetermined pressure load to said closure means against the wall means to thereby extrude the film through the opening means sufficiently to force the extrudate along said edge means and to thereby effect a thickening of the area of the extrudate adjacent to said edge means without materially thickening the portion of the film centered in the opening means.

4. A method of making a non-detachable opening means in wall means of a container component comprising the steps of providing a wall means, providing in said wall means pour opening means;

providing tape means of formable, gas impermeable materials including at least part metal and part thermoplastic material;

applying a peelable, heat activatable adhesive to one of said tape and wall means;

positioning said tape means with the thermoplastic material against one side of said wall means so that said adhesive is between said tape and wall means;

applying heating means to selected areas of said tape means against the metal part thereof for conduction transmission of heat therethrough to said adhesive through said metal to cause said thermoplastic material to bond the tape means to the wall means in the region of the pour opening means in closing relation thereto and in regions spaced from the pour opening means only in limited areas sufficient to hold the tape means to the wall means, and concurrently with bonding of the thermoplastic material to the wall means pressing against said tape means under sufficient load to extrude the thermoplastic material through said pour opening means to form from said thermoplastic material a continuous thick pressure-resistant bead within the pour opening means and to form a relatively thin adhesively superior film bond of said thermoplastic material about said pour opening means.

5. The method according to claim 4 and applying a non-peelable adhesive to at least one of said wall and said tape means, and bonding said non-peelable adhesive by applying a heating means to the tape means, and pressing the non-peelable adhesive against the wall means in an area spaced from the pour means.

6. The method according to claim 4 wherein the thermoplastic material used is polypropylene.

7. The method according to claim 6 wherein the metal used is aluminum.

8. A method of sealing an operable pressure-resistant closure over an opening in a container wall member comprising the steps of providing:

a closure comprising a laminate strip member of metal and thermoplastic material to be positioned in overlying relation to the opening in the wall member, applying a carboxylated polypropylene resin to one of said members, heating at least one of said members to an extent to melt the thermoplastic material attendant to applying it to said wall member with said resin located between said members and pressing said strip to extrude an amount of said thermoplastic material into the opening sufficient to form a bead of the thermoplastic material within the opening thicker than the thermoplastic material in alignment with the opening sufficient to resist internal pressure developed in the container.

* * * * *